United States Patent [19]

Schaetti

[11] Patent Number: 4,571,351

[45] Date of Patent: Feb. 18, 1986

[54] METHOD FOR COATING BACK-CLOTH WITH A POWDERY SYNTHETIC PRODUCT

[75] Inventor: Josef Schaetti, Wallisellen, Switzerland

[73] Assignee: Schaetti & Co., Switzerland

[21] Appl. No.: 616,229

[22] PCT Filed: Oct. 10, 1983

[86] PCT No.: PCT/CH83/00114

§ 371 Date: May 24, 1984

§ 102(e) Date: May 24, 1984

[87] PCT Pub. No.: WO84/01526

PCT Pub. Date: Apr. 26, 1984

[30] Foreign Application Priority Data

Oct. 18, 1982 [CH] Switzerland ..... 6045/82

[51] Int. Cl.[4] ..... B05D 5/00

[52] U.S. Cl. ..... 427/288; 427/195; 427/197; 427/374.4; 427/375; 427/398.2; 427/428

[58] Field of Search ..... 427/208.2, 398.2, 428, 427/374.4, 375, 195, 197, 261, 288

[56] References Cited

U.S. PATENT DOCUMENTS

| | | | |
|---|---|---|---|
| 4,055,688 | 10/1977 | Caratsch | 427/195 |
| 4,139,613 | 2/1979 | Hefek | 427/261 |
| 4,264,644 | 4/1981 | Schaetti | 427/195 |

FOREIGN PATENT DOCUMENTS 0857110 12/1960 United Kingdom .

*Primary Examiner*—Norman Morgenstern
*Assistant Examiner*—Janyce A. Bell
*Attorney, Agent, or Firm*—Thomas W. Speckman

[57] ABSTRACT

With known methods for coating back-cloth with a synthetic powdery product, the back-cloth is subjected to heat treatments; either the length of cloth is used as a heat conveyor, or it is traversed by heat radiation. The present method allows to avoid this. Owing to a metering unit (2), the synthetic powdery product passes from a powder storage tank (1) to the powder dispensing and supply compartment (3) wherefrom it is distributed on a transport surface (5) by means of a scraper (4). Heat sources (7–9) operate without contact, directly to the synthetic powdery product arranged on the intermediary carrier. The back-cloth to be coated (11) is pressed by means of a pressure cylinder (10) against the intermediary carrier (5) where the mostly adhesive powder adheres immediately to the back-cloth (11).

15 Claims, 1 Drawing Figure

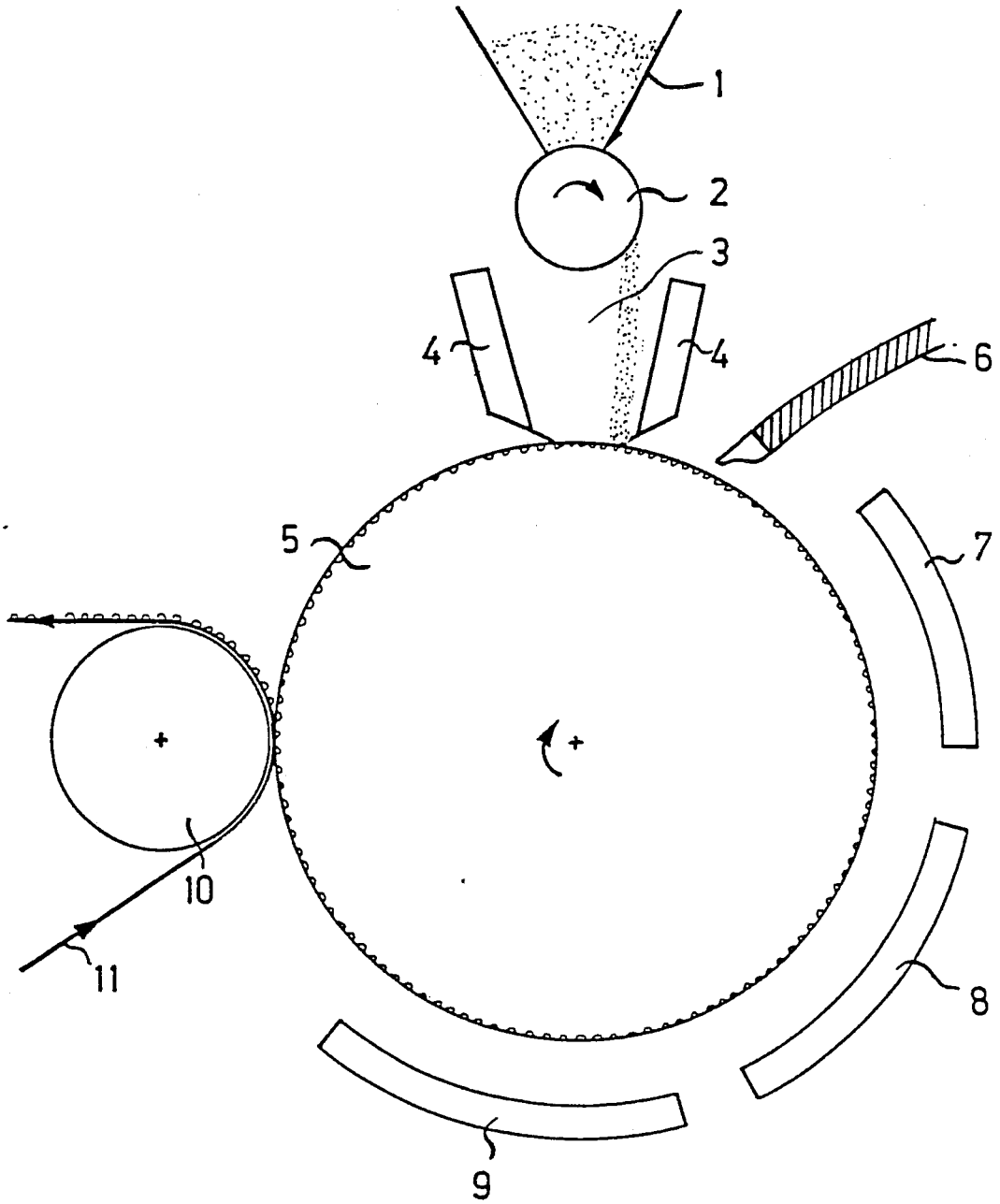
1
2
3
4
4
6
5
7
10
11
8
9

METHOD FOR COATING BACK-CLOTH WITH A POWDERY SYNTHETIC PRODUCT

BACKGROUND OF THE INVENTION

1. Field of the Invention

Lengths of cloth with synthetic coatings are known. The coating can in principle be applied with powder or pastes. The application and distribution of the synthetic product can be made directly, for example, by sprinkling a powder on the back-cloth, or indirectly by means of an intermediary carrier in the form of an engraved roller or a perforated cylinder. Sprinkling methods have the drawback that the powder is deposited without uniformity due to the effects of electrostatic forces. On the other hand, a method in which the powder is applied to the length of cloth by means of an intermediary carrier in the form of an engraved roller has the advantage of a uniform coating being applied without the presence of the disturbing forces of electrostatic charges.

2. Description of the Prior Art

The application of the material deposited in the recesses of engraved roller to the length of cloth must be done by means of heat. In addition, the length of cloth has to be brought into contact with the engraved roller. Hitherto it has not been possible to handle separately the twofold task of, on the one hand, getting the powder onto the length of cloth through the contact of the engraved transport surface and, on the other, supplying enough heat to the powdery synthetic product for it to develop the necessary adhesive strength to stick to the length of cloth.

Thus in one method the length of cloth had to be heated so high by upstream heat sources that upon contact of the hot length of cloth the powder in the recesses of the engraved and cooled roller adhered instantly to the roller. Another method provides for fusing the powder through the back-cloth in contact with the engraved roller and thus providing an adhesive bond with the backing.

Although the temperature handling actually depends only on the nature of the powder used, which can have a higher or lower melting point, the nature of the back-cloth to be coated plays a complicating role in all hitherto-known coating methods using an intermediate carrier, such as an engraved roller. Thus, the temperature regulation, depending on the method used, is governed by how thick the length of cloth to be treated is, what color it is, what its heat conductivity or permeability to radiation is, what its heat capacity is, and what its chemical nature is.

SUMMARY OF THE INVENTION

The present invention concerns a method for the coating of a back-cloth of woven or unwoven material made of natural or synthetic fibers in which the powder is distributed over an intermediary carrier having recesses, at a temperature that prevents the adhesion of the powder to the intermediary carrier during the dispensing and distribution.

It is an objective of the present invention to create a method of the above indicated kind in which the temperature regulation can be independent of the length of cloth to be treated.

This objective is achieved by the method for coating a back-cloth in which a powdery synthetic product is applied to an intermediary carrier provided with recesses at a temperature that prevents the adhesion of said powder to said intermediary carrier during the application and distribution, characterized by the fact that the powder introduced into the recesses of the intermediary carrier is changed by the supplying of heat during the transport on the intermediary carrier into a very adhesive state and after the heating is picked up out of the recesses of the intermediary carrier by contact with the back-cloth.

In this case, the heat is applied without the interference by the back-cloth directly to the powder imbedded in the recesses of the intermediary carrier. Due to the absence of the back-cloth in the area of the heat application to the powder, the whole matter of the heat regulation is considerably simplified as only the constant mechanical factors and the varying kind of powdery synthetic product have to be taken into consideration in the regulation of the temperature.

The back-cloth is pressed by a pressure cylinder against the intermediary carrier, although other mechanical means can be used.

Since it is desirable that the powder in the recesses of the intermediary carrier develop an adhesiveness which increases from the inside to the outside of the recesses when the heat is applied, the heat is advantageously applied to the powder from outside of the intermediary carrier.

BRIEF DESCRIPTION OF THE DRAWING

The method according to the invention is explained below with the help of the attached drawing wherein the FIGURE schematically shows the end view of an apparatus for conduct of the process for one embodiment of this invention.

DESCRIPTION OF THE PREFERRED EMBODIMENTS

The appropriate powder which the user wishes to use for the method is held in a powder storage tank 1. The powder contained in the storage tank 1 is removed from the tank by means of a metering unit according to the capacity of the recesses provided in an intermediary carrier 5. One possible form of such a metering unit is a metering cylinder 2. Shaker sieves or rotating brushes can also be used, or even other metering devices that are known to the art.

From the metering unit a curtain of powder falls into a powder dispensing and supply compartment 3 that on at least one side is bounded by a cooled scraper 4, but preferably is bounded on two sides by cooled scrapers 4. The two scrapers 4 represented here as spreading scrapers 4 are in contact with the surface of the intermediary carrier 5.

The front scraper 4 in relation to the direction of movement of the intermediary carrier 5, which is represented here as an engraved cylinder, serves basically simply to limit the powder distribution and supply compartment. The rear cooled scraper 4 in relation to the direction of movement of the intermediary carrier 5 provides for the complete filling of the recesses in the intermediary carrier with powder and scrapes off any excess. With the correct metering of the powder supply there is always only a small amount of powder in compartment 3 which is continuously worked.

The intermediary carrier 5, which acts as a transport surface for the powder, can be a known engraved cylinder, as it is called in the powder-coating technology, but other types of intermediary carrier 5 can be used. The intermediary carrier can be equipped with cooling and/or heating means in order to provide a constant surface temperature.

The moving intermediary carrier and therewith the powder scraped into its recesses now comes into a relatively large heat-treatment zone. In this zone one or more heat sources 7, 8, 9 can apply heat, in a manner determined by the kind of powder, directly to the powder held in the recesses.

In contrast to other methods, here the back-cloth to be coated is not in the way. The regulation of the heat supply is thus determined only by the powder used, the back-cloth itself is not exposed to these undesirable effects of heat. Depending on the heat source 7, 8, 9 used, the application of the heat can be contactless, such as, by means of heat radiation or heat conduction or heat conveyance. Also, combinations of different heat sources are feasible. Depending upon the situation, heating surfaces or rollers, heat radiators or hot air can be used.

Under the influence of the application of heat, the powdery synthetic material deposited in the recesses of the intermediary carrier is softened and so fused onto the layer adjacent to the heat source that great adhesive forces develop here.

Following this heat application zone the back-cloth to be coated is brought into contact with the principally adhesive powder.

For this purpose, the back-cloth to be coated 11 can be led around or against a pressure cylinder 10 which presses the back-cloth against the intermediary carrier 5. The principally adhesive powder now adheres instantly to the back-cloth to be coated and is drawn out of the recesses in the intermediary carrier by the back-cloth running around the pressure cylinder 10. Here too, again, the temperature can be regulated by cooling means in the cylinder, whereby a drop in temperature between the surface of the intermediary carrier and back-cloth to be coated can be achieved.

Although the most important area of application of the method is seen in the coating of back-cloth, the method can certainly be extended for use with other materials. The gentle treatment of the back-cloth, which is not subjected to a heat treatment, affords important advantages for the coating of all heat-sensitive materials, such as textiles with a high proportion of synthetic fibers, imitation leather, spun materials and felts, paper and laminates, to mention only a few possibilities.

With the method according to the invention, it is important that all the material transported through the heating zone and softened be removed from the intermediary carrier. For this, it is necessary that the surface of the intermediary carrier loaded with powder be at least as wide as the back-cloth to be coated. Also, the powder-covered surface of the intermediary carrier must be brought into matching coverage contact with the surface of the back-cloth to be coated. This can be achieved either by removing powder upstream of the heat application zone by suctioning off of the powder that cannot be made to coincide laterally with the back-cloth to be coated, or by means of the appropriate control of the lateral guidance of the length of cloth 11.

To prevent adhesion of the powder under the influence of the heat application, the intermediary carrier can, if necessary, be provided with a teflon coating.

Even when a metering unit is used, a small amount of powder supply lies directly on the intermediary carrier. If the powder remains for a certain time under the influence of heat, lumps can form. This can be avoided by means of a powder distributing device that keeps the powdery synthetic product moving.

I claim:

1. In a method for coating a back-cloth with a synthetic powder which softens to an adhesive state when heated, said powder being deposited in recesses of a movable intermediary carrier maintained at a temperature that prevents the adhesion of said powder to said intermediary carrier, the improvement comprising moving said carrier with said powder in said recesses, sequentially applying heat directly to said powder deposited in said recesses of said intermediary carrier to change it into said softened adhesive state during movement of said movable intermediary carrier through a zone of direct heat application, and then contacting said softened adhesive powder in said recesses of said intermediary carrier with said back-cloth, said back-cloth at a lower temperature than said intermediary carrier, adhering said synthetic powder to said back-cloth.

2. Method according to claim 1, characterized by the fact that adhesion of powder to said intermediary carrier is prevented solely by maintaining said carrier at a temperature sufficient to prevent said adhesion.

3. Method according to claim 1, characterized by the fact that said back-cloth to be coated is led around a pressure cylinder which presses said back-cloth to be coated into contact with said intermediary carrier.

4. Method according to claim 1, characterized by the fact that heat applied in said heat application zone is applied to said synthetic powder from outside said intermediary carrier.

5. Method according to claim 1, characterized by the fact heat applied in said heat application zone is applied to said powder without contacting said powder.

6. Method according to claim 1, characterized by the fact that said powder is distributed from a powder storage compartment, deposited in said recesses of said intermediary carrier, and distributed in said recesses by means of at least one cooled scraper.

7. Method according to claim 1, characterized by the fact that said powder is metered according to the capacity of said recesses in said intermediary carrier from a powder storage tank into a powder dispensing and supply compartment, and is deposited in said recesses.

8. Method according to claim 1, characterized by the fact that the width and location of application of said powder to said intermediary carrier are arranged prior to treatment in said heat application zone to correspond to the width and contact location of said back-cloth with said intermediary carrier.

9. Method according to claim 1, characterized by the fact that lateral guidance of said back-cloth to correspond to the area of contact with said powder deposited in said recesses in said intermediary carrier is regulated in accordance with application of said powder to said intermediary carrier.

10. Method according to claim 1, characterized by the fact that the distribution of said powder on said intermediary carrier is achieved by means of a dispensing unit.

11. Method according to claim 1, characterized by the fact that adhesion of said powder to said intermediary carrier is additionally prevented by means of a teflon coating applied thereto.

12. Method according to claim 1, characterized by the fact that said back-cloth is unwoven material.

13. Method according to claim 1, characterized by the fact that said back-cloth comprises natural fibers.

14. Method according to claim 1, characterized by the fact that said back-cloth comprises synthetic fibers.

15. In a method for coating a back-cloth with a synthetic powder which softens to an adhesive state when heated, said powder being deposited in recesses of a movable intermediary carrier maintained at a temperature that prevents the adhesion of said powder to said intermediary carrier, the improvement comprising moving said carrier with said powder in said recesses, sequentially applying heat directly to said powder deposited in said recesses of said intermediary carrier to change it into said softened adhesive state during movement of said movable intermediary carrier through a zone of direct heat application, leading said back-cloth to be coated around a pressure cylinder which presses said back-cloth to be coated into contact with said intermediary carrier, said pressure cylinder maintained at a temperature below that of said intermediary carrier, thereby contacting said softened adhesive powder in said recesses of said intermediary carrier with said back-cloth, said back-cloth at a lower temperature than said intermediary carrier, and adhering said synthetic powder to said back-cloth.

* * * * *